United States Patent [19]

Li

[11] 4,144,598

[45] Mar. 20, 1979

[54] DRAIN CLEARING DEVICE

[76] Inventor: Steven S. Li, 113A Division St., New York, N.Y. 10002

[21] Appl. No.: 872,789

[22] Filed: Jan. 27, 1978

[51] Int. Cl.[2] ..... E03D 1/11; E03C 1/306

[52] U.S. Cl. ..... 4/256

[58] Field of Search ..... 4/255, 256, 257; 15/406, 104.05; 134/167 C, 24

[56] References Cited

U.S. PATENT DOCUMENTS

| | | | |
|---|---|---|---|
| 446,283 | 2/1891 | Danaher | 4/255 |
| 1,314,261 | 8/1919 | Griesche | 4/256 |
| 1,768,178 | 6/1930 | Watson | 4/256 |
| 2,036,614 | 4/1936 | Thorp | 4/256 |
| 2,187,043 | 1/1940 | MacMillan | 4/256 X |

FOREIGN PATENT DOCUMENTS

| | | | |
|---|---|---|---|
| 17800 of | 1911 | United Kingdom | 4/256 |

*Primary Examiner*—Stuart S. Levy
*Attorney, Agent, or Firm*—Daniel Jay Tick

[57] ABSTRACT

A semi-spherical drain-blocking member of soft rubber fits in a drain opening. A plunger and water supply device extend through the drain-blocking member. The plunger has a plunger member coaxially mounted in a plunger pipe for movement in axial directions and extending at one end out of the drain-blocking member. A water supply pipe extends from the plunger pipe and is coupled to a water hose.

1 Claim, 5 Drawing Figures

DRAIN CLEARING DEVICE

BACKGROUND OF THE INVENTION

The present invention relates to a drain clearing device.

Objects of the invention are to provide a drain clearing device of simple structure, which is inexpensive in manufacture, used with facility and convenience, and functions efficiently, effectively and reliably to clear a drain of any size with facility and rapidity.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
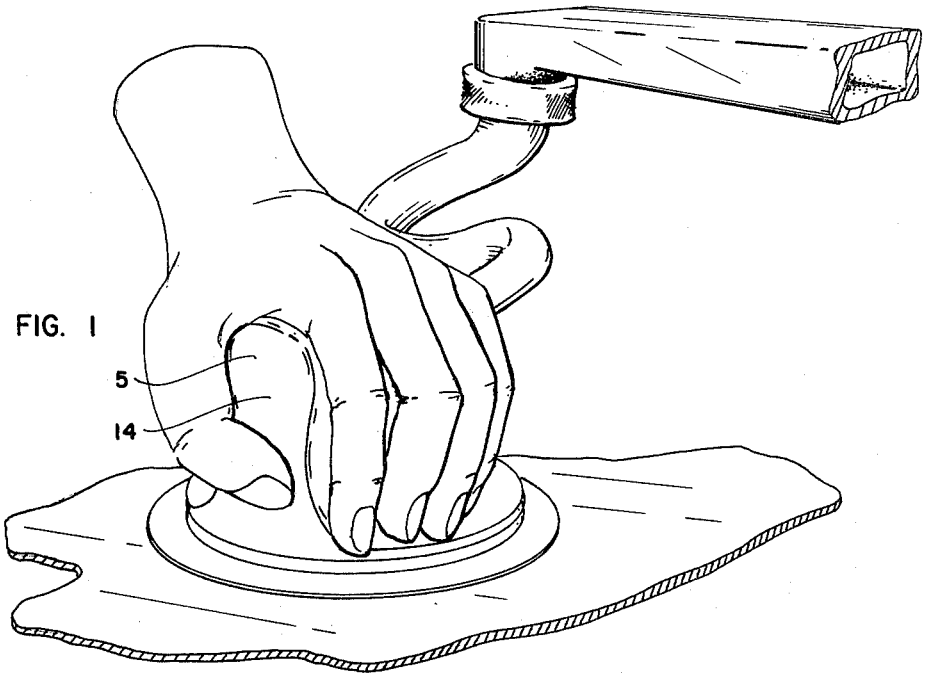
FIG. 1 is a perspective view of an embodiment of the drain clearing device of the invention in use.
Figure 3:
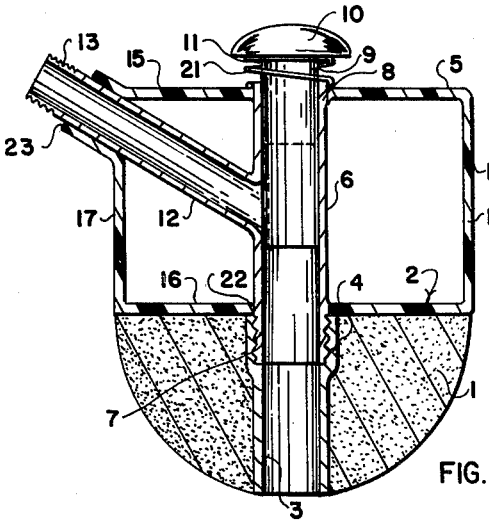
FIG. 3 is a view, on an enlarged scale, partly in section, of the embodiment of FIG. 2 in a first condition of operation.
Figure 4:
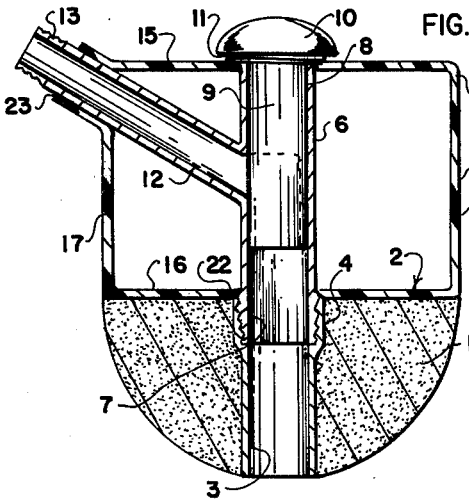
FIG. 4 is a view, on an enlarged scale, partly in section, of the embodiment of FIG. 2 in a second condition of operation.

The drain clearing device of the invention comprises a semi-spherical drain-blocking member 1 of soft rubber (FIGS. 2 to 4) adapted to fit in a drain opening. The drain-blocking member 1 may be provided in different sizes for different drain openings. The drain-blocking member 1 has, as shown in FIGS. 3 and 4, a substantially planar top 2 and a diametrical duct or pipe 3 extending therethrough at right angles to the top. The diametrical duct or pipe 3 has an internally threaded part 4 adjacent the top 2.

A plunger and water supply device 5 comprises a plunger pipe 6 (FIGS. 3 and 4) having spaced opposite first and second ends 7 and 8, respectively, as shown in FIGS. 3 and 4. The first end 7 has an externally threaded part threadedly coupled to the duct 3 of the drain-blocking member 1 (FIGS. 3 and 4).

Figure 2:
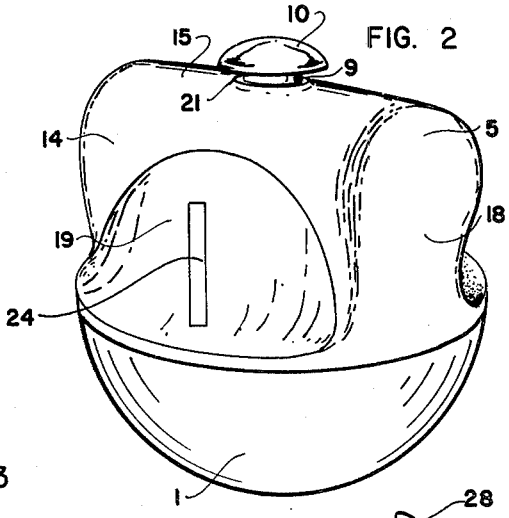
FIG. 2 is a perspective view, on an enlarged scale, of the drain clearing device of FIG. 1.

A plunger member 9 (FIGS. 3 and 4) is coaxially movably mounted in the plunger pipe 6 for movement in axial directions and extends from the second end 8 of the plunger pipe for manual operation via a knob or head 10 (FIGS. 2 to 4). A return spring 11 is positioned around the plunger member 9 at the end thereof outside the plunger pipe 6 for urging the plunger member out of the plunger pipe. The return spring 11 is maintained on the plunger member via the head 10 thereof. The lower portion of the plunger member 9 is hollow and open as shown in dotted lines in FIG. 4 to permit water from a water pipe 12 to reach the pipe 3.

The water pipe 12 (FIGS. 3 and 4) extends from the plunger pipe 6 and has an externally threaded free end 13 (FIGS. 3 and 4) for coupling to a water hose.

The plunger and water supply device 5 is enclosed in a housing 14 of any suitable material such as, for example, plastic. The housing 14 has a top 15, bottom 16 and sides 17 (FIGS. 3 and 4), 18 (FIGS. 2 to 4), 19 (FIG. 2) and a side opposite the side 19 (not shown in the FIGS.). A hole 21 is formed through the top 15 for accommodating the plunger pipe 6, as shown in FIGS. 2 and 3. A hole 22 is formed through the bottom 16 of the housing 14 for accommodating the plunger pipe 6, as shown in FIGS. 3 and 4. A hole 23 is formed through the side 17 (FIGS. 3 and 4) for accommodating the water supply pipe 12.

In use, the drain-blocking member 1 is placed in a drain opening and the plunger member 9 is manually moved in axial directions to clear the drain, during which process water is supplied via the water supply pipe 12 to determine the extent of clearing of the drain.

Figure 5:
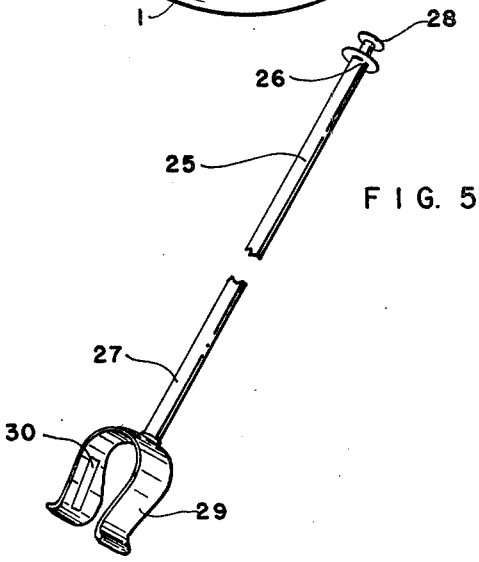
FIG. 5 is a perspective view of an embodiment of a support rod for the drain clearing device of the invention.

Indentations 24 (FIG. 2) are formed in the sides 19 and 20 of the housing 14 to align a support rod 25 (FIG. 5). The support rod 25 is used to support the drain clearing device of the invention at a distance from the hand of a user.

The support or extension rod 25 has spaced opposite first and second ends 26 and 27 (FIG. 5). A handle 28 is provided at the first end 26 (FIG. 5). A U-shaped elastic clamp 29 is affixed to the second end 27 of the rod 25 and extends therefrom (FIG. 5). The inside surfaces of the clamp 29 have projections 30 (FIG. 5) extending therefrom for accommodation in the indentations 24 for releasably securing the drain clearing device in the support rod.

While the invention has been described by means of a specific example and in a specific embodiment, I do not wish to be limited thereto, for obvious modifications will occur to those skilled in the art without departing from the spirit and scope of the invention.

I claim:

1. A drain clearing device, comprising a semi-spherical drain-blocking member of soft rubber adapted to fit in a drain opening, said drain-blocking member having a substantially planar top and a diametrical duct extending centrally therethrough at right angles to the top and having an internally threaded part adjacent said top; and a plunger and water supply device comprising a plunger pipe having spaced opposite first and second ends, the first end having an externally threaded part threadedly coupled to the duct of the drain-blocking member and extending upwardly therefrom, a plunger member coaxially movably mounted in the plunger pipe for movement in axial directions and extending upwardly from the second end of the plunger pipe for manual operation, a return spring around the plunger member at the end thereof outside the plunger pipe for urging said plunger member out of said plunger pipe and a water supply pipe extending from the plunger pipe and having an externally threaded free end for coupling to a water hose, said the lower portion of the plunger member 9 being hollow and open to permit water from said water pipe to reach said duct, plunger and water supply device further comprising a housing plastic having a top, a flat bottom in contact with the planar top of the drain blocking member, sides, a hole formed through the top for accommodating the plunger pipe, a hole formed through the bottom for accommodating the plunger pipe and a hole formed through a side for accommodating the water supply pipe, the sides of the housing having indentations formed therein; and a plunger knob connected to said plunger member with said return spring mounted between the housing and said knob, and wherein said housing sides curve downwardly from the top to conform to the hand of a user whereby upon grasping of the drain clearing device the palm of the hand of the user will engage the knob of the plunger member.

* * * * *